United States Patent [19]

Elkern et al.

[11] 4,310,746

[45] Jan. 12, 1982

[54] ELECTRIC FLUID HEATING APPARATUS

[76] Inventors: Kenneth E. Elkern, 3008 Chicago Rd., South Chicago Heights; Henning H. Nielsen, R.R. 3, Box 1197, Crete, both of Ill. 60417

[21] Appl. No.: 903,933

[22] Filed: May 8, 1978

Related U.S. Application Data

[63] Continuation-in-part of Ser. No. 709,542, Jul. 28, 1976, abandoned.

[51] Int. Cl.[3] ..... H05B 1/00; F24H 3/08; F28D 15/00

[52] U.S. Cl. ..... 219/326; 122/176; 122/264; 122/367 C; 126/101; 126/350 R; 165/104.31; 165/104.32; 219/341; 219/365

[58] Field of Search ..... 122/264, 265, 135 R, 122/173, 176, 177, 166 R, 166 A, 367 R, 367 C; 126/350 R, 351, 101; 219/341, 365, 325, 326, 279, 303, 304; 165/104 R, 105, 107 R; 237/7, 16

[56] References Cited

U.S. PATENT DOCUMENTS

| | | | |
|---|---|---|---|
| 884,540 | 4/1908 | Thomson | 219/365 |
| 1,408,634 | 3/1922 | Passmore et al. | 219/279 |
| 1,758,474 | 5/1930 | Seehaus | 219/365 |
| 2,366,318 | 1/1945 | Del Vecchio | 219/279 |
| 2,573,364 | 10/1951 | Scharff | 219/365 X |
| 3,140,824 | 7/1964 | Moore | 219/365 |
| 3,249,093 | 5/1966 | Curren | 122/176 |
| 3,805,745 | 4/1974 | Block et al. | 122/367 C |
| 3,889,642 | 6/1975 | Fung | 122/264 |
| 4,091,768 | 5/1978 | Widdershoven | 122/367 C |

FOREIGN PATENT DOCUMENTS

| | | | |
|---|---|---|---|
| 623547 | 2/1963 | Belgium | 219/365 |
| 10325 | 8/1879 | Fed. Rep. of Germany | 219/341 |
| 2505765 | 8/1976 | Fed. Rep. of Germany | 122/367 R |
| 2728807 | 1/1978 | Fed. Rep. of Germany | 126/101 |
| 766407 | 4/1934 | France | 126/350 R |
| 1458528 | 10/1966 | France | 122/367 C |
| 6757 | of 1915 | United Kingdom | 122/367 C |

*Primary Examiner*—A. Bartis
*Attorney, Agent, or Firm*—Darby & Darby

[57] ABSTRACT

A fluid heating apparatus includes a thermally insulated housing divided by a thermally insulated vertical partition into a flue passage and a heat exchange chamber, the partition having top and bottom openings providing communication between the passage and the upper and lower ends of the chamber. A heat exchanger comprising an array of pipes and fins is arranged in the chamber such that an air plenum is provided above the heat exchanger and a firebox is provided below the heat exchanger. The fire box is lined with firebrick and a plurality of electric heating elements are arranged in the firebox. A fan is provided in the housing for circulating air from the flue passage, through the lower opening to the firebox, over the heating elements, up over the heat exchanger to the plenum and through the top opening to the flue passage. Means are provided for circulating fluid to be heated through the pipes of the heat exchanger to a point of use, e.g. the heat exchanger of a residential air heating system.

2 Claims, 4 Drawing Figures

ELECTRIC FLUID HEATING APPARATUS

This is a continuation-in-part of application Ser. No. 709,542, filed July 28, 1976 now abandoned.

The present invention relates to fluid heaters and more particularly to a fluid carrying heat exchange system adapted for use in a forced air residential heating plant.

BACKGROUND OF THE INVENTION

Heretofore, heating systems for residential use have included heat exchange devices in which a fluid is passed through metal passageways heated to relatively high temperatures by combustion gases rising from a heat producer such as a gas burner.

In the case of a typical forced-air furnace, the exterior surface area of the exhaust channels radiate the heat from inside of the heat exchanger. The heated air is directed by an air handler into the warm-air plenum of a network of ducts in the residence. The burned gas passes through the inside of the heat exchanger to the vent outlets and then to the stack.

Boilers for typical hot water heating systems contain boiler sections kept filled by circulating water. The hot combustion gases from the burner flow past the water filled sections, heat them and escape via a stack. Heating efficiency in this type of system results from heating the water to above boiling, for example, from 200° to 230° fahrenheit. The water does not become steam because it is under pressure in the system.

In either of these systems the furnace or boiler usually consists of elongate hollow metal sections which may be flat or somewhat curved and which have relatively large interior and exterior surface areas. Such heat exchangers generally work well, but require large quantities of heat and thus consume proportionate quantities of fuel. Accordingly, heat efficiency in these systems is achieved at the expense of cost efficiency.

Previously known coil-type heat exchangers have been thought to exhibit disadvantages. Examples of such heat exchangers are set forth in U.S. Pat. Nos. 2,823,652 to C. K. Mader, 3,267,909 to B. E. McClanahan and 3,612,004 to E. Cancilla et al. These patents describe helical and ring-type heat exchange tubes provided with exhaust baffle elements or deflectors which extend between adjacent turns of the coil or which are otherwise positioned to block or interfere with the flow of combustion gases through the coil. Baffles of this type are provided to recycle the combustion gases over the coil or to compensate for coil distortion resulting from expansion and contraction which would otherwise tend to open the exhaust passages. However, the baffles or deflectors diminish the velocity of the exhaust gas molecules flowing by the coil. This means that heat exchange efficiency between the exhaust gas molecules and the surface area of the coil is reduced. Moreover, the coils and baffles will tend to coke-up with time thereby further reducing heat exchange efficiency. Accordingly, the heat producer is selected so as to provide an enormous quantity of heat, sometimes on the order of 2,000,000 BTU's per hour. These arrangements, therefore, including the tube-type heat exchanger described in U.S. Pat. No. 3,734,065 to E. A. Reid, Jr. et al are designed for high output heat producers where a large volume of a heated fluid is required, as for example in swimming pools or for commercial use in the petroleum and chemical industries.

SUMMARY OF THE INVENTION

In contrast, the present invention provides a fin-tubed heat exchange device for use in a residential heating system. The heat exchanger includes a plurality of heat conductive baffles oriented parallel to the direction of flow of the exhaust gases and which support an array of substantially horizontal fluid conduits or tubes arranged perpendicularly to the baffles. The horizontal tubes pass through and may be supported by substantially all of the baffles. The tubes are aligned so as to define a plurality of open passages between the baffles and the tubes extending completely through the heat exchanger from top to bottom. In the absence of deflectors, the convection flow of exhaust gases across the heat exchanger is substantially unimpeded within the passages. Heat exchange efficiency between the moving gas molecules and the baffles and tubes forming the boundaries of the passages is thus maximized. Moreover, the baffles present two major surface areas to the combustion gases for maximum heat absorption. The tubes in the heat exchanger may carry water in a closed loop hot water system or, where desired, may carry forced air which is warmed by the tubes and thereafter enters the ducts of the heat distribution system. The exhaust stack is preferably connected to the heat exchanger by way of a pressure dome in the form of a truncated cone. In this way, convection currents across the heat exchanger are substantially unaffected by any pressure build-up near the relatively small diameter opening to the stack. If such a pressure gradient develops, it is substantially within the pressure dome and not across the heat exchanger.

A means for conveying heated exhaust gases across the heat exchanger at a substantially constant velocity of convection is also provided in the present invention. That conveying means may comprise a gas plenum at the end of the heat exchanger, a gas recycling duct extending between and in fluid flow communication with the gas plenum and heating source, and a fan mounted between the air plenum recycling duct so that heated gas traverses the flow paths by convection from the source and is then directed through the recycling duct by the fan for return for re-heating.

BRIEF DESCRIPTION OF THE DRAWINGS

For a further understanding of the present invention, reference may be had to the following drawings in which.

BRIEF DESCRIPTION OF THE PREFERRED EMBODIMENTS

Figure 1:
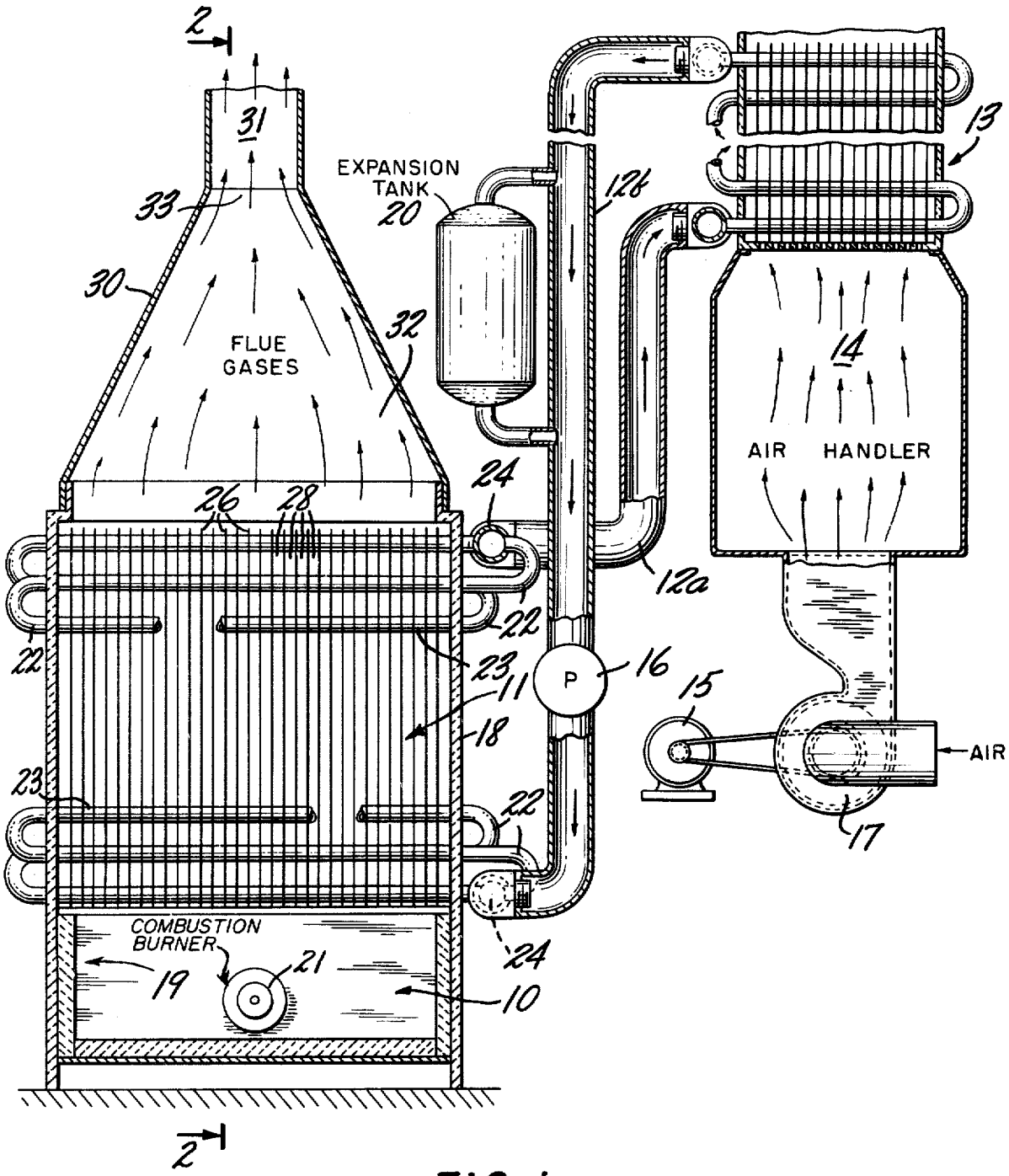
FIG. 1 is a schematic illustration of a heating system which utilizes the present invention.

Referring now to the drawings, and in particular to FIG. 1, there is illustrated one embodiment of a system utilizing the present invention for heating a residence. Such systems normally have a heat generating capacity of less than 50,000 BTU. The system includes a heat producer indicated generally by reference numeral 10, and a heat exchanger 11 mounted above and closely adjacent the heat producer for absorbing heat generated by the latter. The heat exchanger contains an array of tubing which is connected by fluid transport conduits or pipes 12*a* and 12*b* to another similar heat exchanger 13 mounted adjacent air handler apparatus designated generally by reference numeral 14. A suitable fluid, preferably water, is sealed with a circulatory system which includes the hot water pipes 12*a*, return water pipes 12*b* and the arrays of tubing within the two heat exchangers. A Bell and Gossett type pump 16 is preferably utilized as a circulator for the system fluid. These components together form a sealed loop liquid heating system. Where copper piping is utilized for the transport pipes and for the heat exchanger arrays, the sealed system should remain intact for many years. In the preferred embodiment, pump pressure is approximately 2 lbs. to 5 lbs. per square inch. Because of such operating pressure, the present system is safer than prior types of home heating systems.

The air handler 14 contains a suitable blower including a motor 15 and impeller 17. The air handler need not be detailed since it may be of a type readily known to persons having skill in this art. In general, the heat exchanger 13 is mounted closely adjacent the air handler 14. The arrangement is such that the impeller 17 directs ambient air across the heat exchanger 13. Heat absorbed by the circulating water as it is forced through the heat exchanger 11 is given up to the air passing across the heat exchanger 13. The warmed air is thereafter directed into the heating ducts of the building.

In the present embodiment, the heating plant may be provided with certain safety controls. One such control is an expansion tank 20 having a pressure switch to monitor water pressure. If the heating plant begins to overheat and the water pressure rises above a predetermined safe level, the pressure switch would shut-down the heat producer. The switch also prevents ignition of the heat producer while fluid pressure in the system is at an unsafe level.

The circulatory system may be provided with a water flow indicator (not shown). The purpose of the indicator is to prevent the heat producer from igniting if the pump 16 is inoperative.

Where desired, a sail switch (not shown) may also be included in the air plenum adjacent the heat exchanger 13. The sail switch senses the air flow across the heat exchanger 13. If for any reason the blower 17 should fail, the drop in air flow is sensed by the switch and the heating plant is shut down. It should be understood, however, that the foregoing safety arrangements are not to be construed as limiting the scope of the present invention.

In operation, the pump 16 begins to circulate the water when the thermostat calls for heat. If the safety equipment registers a safe condition, the heat producer ignites. Hot exhaust gas is forced upward across the heat exchanger 11. Heat is thereby radiated to the water in the array of pipes within the heat exchanger.

The hot water is pumped from the heating plant through the other heat exchanger 13. Ambient air directed by the air handler 14 across the heat exchanger 13 is thereby heated and enters the hot air ducts within the building. Cooler water leaving the heat exchanger 13 is returned by the pump 16 to the heat exchanger 11 for reheating.

Figure 3:
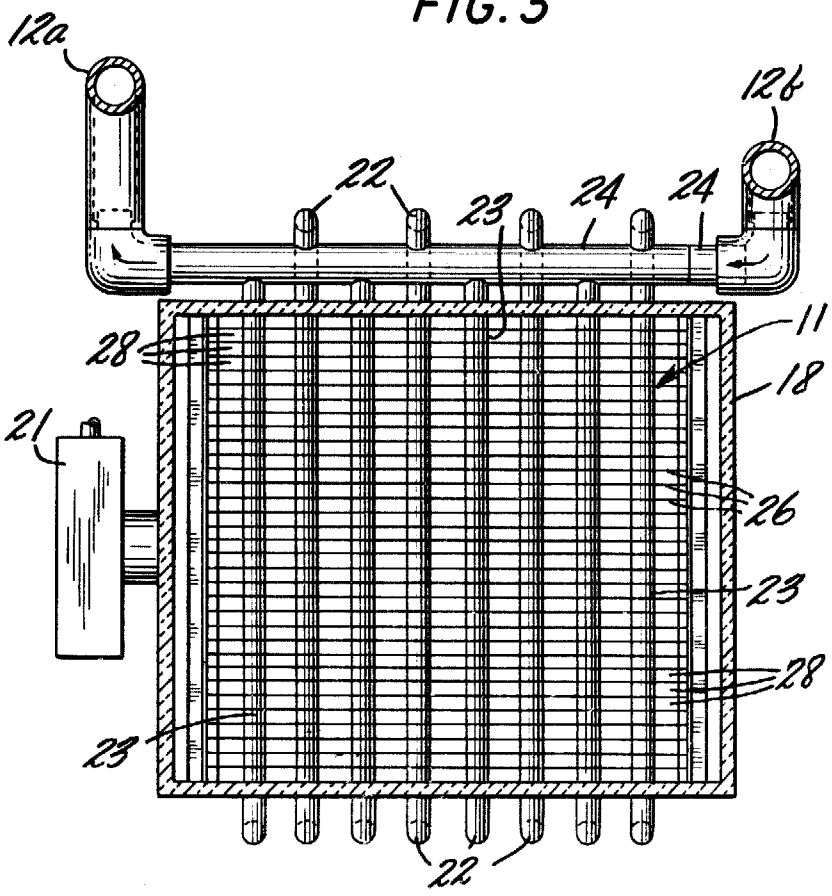
FIG. 3 is an enlarged partial view of the furnace of this invention taken along the line 3—3 of FIG. 2.
Figure 2:
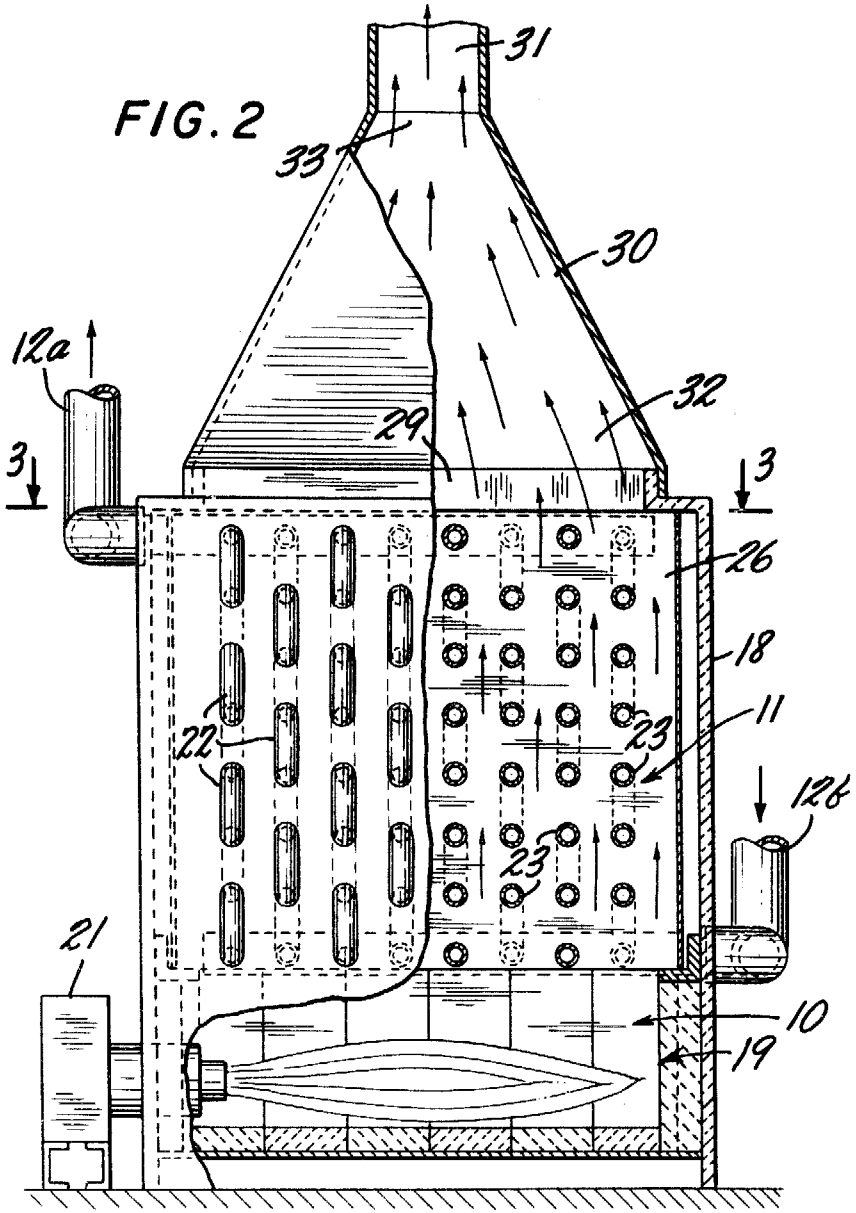
FIG. 2 is a view taken in part along the line 2—2 of FIG. 1 with the addition of certain structural detail.

Referring also to FIGS. 2 and 3, in which the heating plant is illustrated in more detail, there is shown a housing 18 which may extend downwardly so as to encompass a firebox 19 preferably constructed of firebrick. A powered burner 21, preferably gas operated, is sealably mounted at one side of firebox. The firebox is open only at its top. The dimensions of the firebox and the burner adjustments are such that the flame from the burner extends across the entire length of the firebox radiating heat in all directions. The temperature of exhaust gases leaving the firebox 19 may reach 1500° F. Accordingly, heat is also quickly absorbed by the surrounding firebricks. The heat exchanger 11 is mounted at the top of and covers the firebox 19. It should be sealed to the firebox so that all the combustion gases must pass through it.

In the preferred embodiment the heat exchanger 11 consists of a multi-circuit coil characterized by a plurality of reverse bend portions 22 which connect corresponding pairs of substantially horizontal and parallel tubular sections 23. By way of example, a nine circuit coil may contain approximately 80 horizontal sections of copper tubing, each section being approximately ⅝ of an inch in diameter. Some horizontal sections are connected together through the reverse bends 22. Manifold pipes 24 of one inch diameter for example, may also be provided at input and output ends of the coil. The coil is designed to withstand circulating fluid pressures of at least 400 lbs. per square inch and to permit a flow rate of from approximately 12 gallons/minute to 15 gallons/minute.

The tubular sections 23 may be held by a plurality of substantially parallel heat conductive baffles 26 which are vertically arranged across the space above the firebox. The baffles are parallel to the direction of flow of the exhaust gases leaving the firebox and are constructed to withstand the relatively high temperatures to which they are exposed. Aluminum has been found to be an acceptable material for the baffles.

The arrangement of the tubing and baffles is such that there are many hundreds of passages 28 formed between them. The exhaust gases from the firebox pass unimpeded upwardly through the heat exchange coil by way of such passages. A typical arrangement would provide approximately 375 passages. In the embodiment shown, the pipe sections 23 are aligned in a series of vertical columns. The passages 28 are accordingly straight and substantially vertical. The pipe sections might also be staggered in appropriate circumstances to force the convection currents to flow around them.

An alternate arrangement for the heat exchange coil, for example with fewer baffles 26, might include a plurality of heat conductive fins (not shown) attached to each of the tube sections 23. Such fins would also be parallel to the direction of gas flow across the coil.

Water enters the coil through one of the manifold pipes 24. It may enter at the bottom of the coil near the firebox and exit at the top or vice versa. The former arrangement is preferable since heat is exchanged most efficiently when the temperature difference between the circulating water and the exhaust gases passing over the coil is a maximum. All of the horizontal sections 23 are interconnected either directly through the reverse bends 22 or by way of the common input and exit manifold pipes.

The housing 18 is provided with an opening 29 at the top above the coil. The area of the opening in the housing is approximately equal to the horizontal cross-sectional area of the coil. Each of the passages 28 is open at the top of the coil within the area of the opening 29 and is open at the bottom within the area of the firebox 19.

A pressure dome 30 is provided between an exhaust flue or stack 31 and the opening 29 in order to channel exhaust gases to the outside during operation of the heating plant. In the preferred embodiment, the pressure dome is in the form of a truncated cone with the large diameter opening 32 covering the opening 29 at the top of the heat exchanger. For an average size firebox, it has been found that the diameter of the smaller opening 33 at the top of the pressure dome is preferably approximately 6 inches. The pressure dome may be approximately 1½ feet high with the diameter of the large opening 32 being almost 2 feet. The distance from the centerline of the burner 21 to the top of the pressure dome at the opening 33 need only be approximately 3½ feet. The foregoing dimensions are provided as exemplary only, and the present invention is not to be limited thereby.

In accordance with the invention the stack 31 need not contain a pivoting damper commonly employed in home heating plants. Heat transfer effectiveness of a coil of the type described herein is seriously diminished by any interference with the natural upward flow of exhaust gases across the coil.

It should be understood that the pressure dome itself need not necessarily take the form of a truncated cone. It functions inter alia to direct the exhaust gases into the flue. However, its volume relative to the power capacity of the burner 21 must be such as to minimize any pressure build up which might interfere with the continuous flow of exhaust gases across the heat exchange coil. Generally, the pressure dome covers the flow paths and acts to convey heated air out of the flow paths or passages 28 such that its velocity by convection remains substantially constant along the entire length of each of the flow paths.

An example of the efficiency achieved with the present invention is as follows: It has been discovered that for a power burner setting of approximately 85,000 BTU's per square foot per hour with the house thermostat set at 72° F. the temperature in the firebox 19 reaches approximately 1500° F., during an average 2 to 2½ minute burn. Under these conditions, the temperature of the exhaust gas entering the stack 31 after passing through the heat exchange coil is approximately 140° F. The water circulating through the coil has been found to be approximately 15° hotter than the flue discharge temperature. The low stack temperature, of course, results in the present system being safer than other known systems. For an average adequately insulated home of 1,000 square feet, the present heating plant uses about one cubic foot of gas per hour of operation when the outdoor temperature is −20° F.

Efficiency of the system may be facilitated by arranging for the water pump to remain operative for a period of time after the burner shuts down. It has been found that significant heat transfer is achieved merely as a result of heat radiated from the fire bricks. By way of example the present system is able to provide at least six minutes of heat for an expenditure of two minutes of gas burned. Thus gas is conserved while the system continues to deliver heat to the residence.

In some heating plants constructed in accordance with the present invention, it may be desirable to include an outside temperature sensing unit (not shown) and a two-stage gas valve (not shown) for the burner 21. A two-stage valve has two operating sections each of which is controlled by the outside sensing unit. By way of example, when the outside temperature is above 25° F., the valve effects burner firing at the rate of 75,000 BTU's per square foot per hour. When the outside temperature is below 25° F., the valve switches over to effect firing of the burner at 85,000 BTU's per foot per hour.

It may also be desirable to operate the air handler 14 continuously. Heat generated anywhere in the residence is thereby distributed and colder air is not permitted to settle in a particular area. Humidifiers and filters may also be employed to provide a more comfortable environment within the residence.

Although the enbodiment illustrated herein concerns a hot water closed loop heat transfer system having two heat exchangers 11 and 13, the system is susceptible of various modifications which do not depart from the scope of the invention. For example, the heat exchanger 13 might be eliminated so that the hot water output from the heat exchanger 11 can be directly circulated through radiators or similar heating units within the several rooms of the residence. Alternatively, the heat exchanger 11 might, in lieu of an array of water pipes, be provided with several air conduits similarly supported by the baffles 26. Air from a blower would enter one end and exit at the other end, preferably into the air plenum for the hot air ducts of the residence. Such conduits might also be provided with a plurality of fins extending radially inwardly from the internal surface area of the conduits but parallel to and intercepting the air flow through the conduit. The conduits might be of any suitable volume. However, the shape of the conduits must be such as to minimize the external surface area essentially perpendicular to the flow direction of the combustion gases rising from the firebox. Undue interference with convection heating of the heat exchanger is thereby avoided. Such an arrangement would eliminate any heat loss or inefficiency attributable to the use of two heat exchangers successively to transfer heat from combustion gases to water and back to air.

Figure 4:
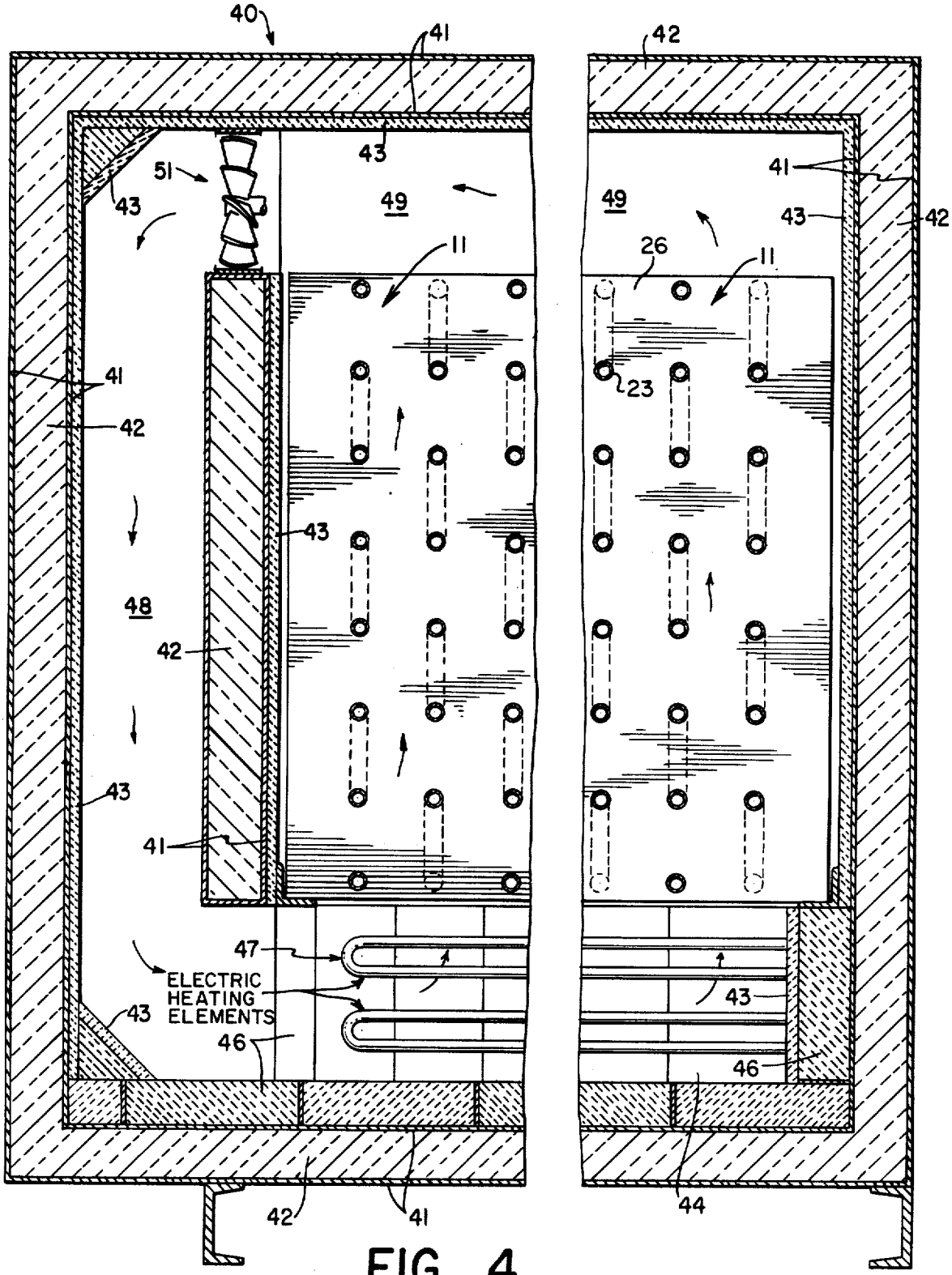
FIG. 4 is an elevated side view in cross-section of an alternate embodiment of the heating system depicted in FIG. 1.

Referring now to FIG. 4, there is shown in cross-section an alternate embodiment of a heating system designed in accordance with the present invention. There, a furnace 40 is provided with a surrounding metal casework or housing 41 beneath which is a suitable form of insulation 42 between the housing and an asbestos board liner 43 which defines the interior surface area of the furnace. The metal housing 41 extends downwardly so as to encompass a conventional firebox 44 preferably constructed of firebrick 46.

A plurality of electrical heating elements 47 extend within the firebox in one direction along its length. The heating elements are mounted within the firebox in accordance with known and acceptable electrical techniques. As was true of the earlier embodiments, the firebox is enclosed in firebrick and is open only at the top.

The heat exchanger 11 is mounted at the top of and covers the firebox 44. The heat exchanger is preferably sealed to the firebox so that all of the air heated by the heating elements and rising upwardly above them must pass through it.

In accordance with the invention, the heating plant is provided with a completely insulated air recycling duct 48 which extends from top to bottom of the plant and is in fluid flow communication through the firebrick wall with the firebox 44. As was true with respect to the furnace housing, the internal surface area of the air recycling duct is lined with asbestos board 43.

The top of the air recycling duct is in fluid flow communication with an air plenum 49 formed directly above the heat exchanger 11. In the present embodiment the furnace housing 41 extends upwardly over the top of the heat exchanger 11 to provide sufficient air space above the coil to form the air plenum. The air plenum however may be provided for in any otherwise suitable fashion.

A flue inducer or fan 51 is positioned at the juncture between the air plenum and the air recycling dust 48. The fan operates to draw heated air out of the air plenum away from the top of the heat exchanger 11 and into the air recycling duct 48. In this way, the fan acts to convey the heated air out of the flow paths of the heat exchanger 11 in such a way that the heated air passes through the flow paths of the heat exchanger at a relatively constant velocity determined generally by the rotational speed of the fan. The air which has lost its heat to the heat exchanger is thereafter recycled into the firebox through the recycling duct and passes across the electric heating elements before entering the flow paths of the heat exchanger once again to complete the cycle. The fan, of course, may continue to recycle hot air across the heat exchanger even when the electric heating elements are turned off. Air passing through the firebox will extract heat from the firebricks and then lose its heat to the fluid passing through the heat exchanger coil.

Other changes and modifications will occur to those skilled in the art. It is therefore intended that the scope of the present invention is not to be limited except as defined by the following claims.

What is claimed is:

1. Heating apparatus comprising:

a thermally insulated housing;

a vertical, thermally insulated partition dividing the housing into a flue passage and a heat exchange chamber, said partition having top and bottom openings to provide communication between the flue passage and opposite ends of the chamber;

a heat exchanger in the heat exchange chamber, said exchanger comprising an array of pipes and fins;

an air plenum above the heat exchanger;

a firebox below the heat exchanger, said firebox lined with firebrick;

heating elements within the firebox;

air moving means in the housing for circulating air from the flue passage, through said bottom opening to the firebox, over the heating elements, up over the heat exchanger to the plenum and from said plenum through said top opening to the flue passage; and means for circulating fluid to be heated through the pipes of the heat exchanger.

2. A heat exchanger as described in claim 1 wherein the heating elements comprise electrical resistance elements.

* * * * *